US009521475B2

(12) United States Patent
Lin et al.

(10) Patent No.: US 9,521,475 B2
(45) Date of Patent: Dec. 13, 2016

(54) MICROPHONE MODULE AND ELECTRONIC DEVICE HAVING THE SAME

(71) Applicant: Wistron Corporation, New Taipei (TW)

(72) Inventors: Cheng-Hsuan Lin, New Taipei (TW); Kai-Hsiang Chang, New Taipei (TW)

(73) Assignee: Wistron Corporation, New Taipei (TW)

( * ) Notice: Subject to any disclaimer, the term of this patent is extended or adjusted under 35 U.S.C. 154(b) by 135 days.

(21) Appl. No.: 14/492,723

(22) Filed: Sep. 22, 2014

(65) Prior Publication Data

US 2015/0245119 A1 Aug. 27, 2015

(30) Foreign Application Priority Data

Feb. 26, 2014 (TW) ..... 103203360 U

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 17/02; H04R 11/04; H04M 1/03; H04M 1/003; H04M 1/02; H04M 1/0283; H04M 1/035
See application file for complete search history.

(56) References Cited

U.S. PATENT DOCUMENTS 6,654,464 B2 * 11/2003 Roussy ..... H01R 13/6608 379/433.03
7,769,195 B2 * 8/2010 Ho ..... H01R 13/6608 379/433.03
8,442,256 B2 * 5/2013 Yoshino ..... H04R 1/08 381/122
2007/0263845 A1 * 11/2007 Hodges ..... H04R 1/345 379/388.02
2008/0159575 A1 * 7/2008 Chu ..... H04R 1/38 381/346
2010/0086124 A1 * 4/2010 Downing ..... H04M 1/03 379/433.03

* cited by examiner

*Primary Examiner* — Fan Tsang
*Assistant Examiner* — Angelica M McKinney
(74) *Attorney, Agent, or Firm* — Brinks Gilson & Lione; John C. Bacoch

(57) ABSTRACT

An electronic device includes a housing having a top wall, and a microphone module mounted in the housing. The microphone module includes a mounting seat having two oppositely spaced-apart upright suspension surfaces extending transversely from the top wall. A buffer member includes a main body disposed between and spaced apart from the suspension surfaces, and two suspension bumps protruding from the main body toward and abutting respectively and tightly against the suspension surfaces. The main body has an inner portion defining an accommodating space. A microphone body is disposed in the accommodating space.

23 Claims, 7 Drawing Sheets

MICROPHONE MODULE AND ELECTRONIC DEVICE HAVING THE SAME

CROSS REFERENCE TO RELATED APPLICATION

This application claims priority of Taiwanese Application Number 103203360, filed on Feb. 26, 2014, the disclosure of which is incorporated herein by reference.

BACKGROUND OF THE DISCLOSURE

1. Field of the Disclosure

The disclosure relates to an electronic device, more particularly to a microphone module for the electronic device.

2. Description of the Related Art

With the improvement of modern living standards, when using an electronic device having a microphone, a user does not only demand that the sound be surely received and conveyed, but also that the sound can be excluded from all the interferences of noise, so that the quality of sound is more real and pleasant. Currently, to install a microphone into an electronic device, a housing of the electronic device is formed with a mounting groove having a shape corresponding to that of the microphone. The microphone is then placed in the mounting groove and abuts tightly against the housing. Thus, the microphone is securely fixed to the housing and the assembly is completed.

However, the aforesaid method of tightly mounting the microphone in the housing has a drawback. When vibration is generated by an external environment or by other components in the electronic device (for example, sound waves generated by a speaker), the vibration is transmitted to the microphone through the housing, so that noise interference occurs during reception of sound by the microphone. Especially, when receiving a sound with a certain specific audio frequency, impact of noise is very remarkable so that the quality of sound reception is significantly deteriorated and severely distorted. How to remove the vibration that generates noise during sound reception of the microphone has always been an issue that current industrial sectors actively involved in research.

SUMMARY OF THE DISCLOSURE

Therefore, the object of the disclosure is to provide a microphone module that can reduce impact of vibration to enhance the quality of sound reception.

Another object of this disclosure is to provide an electronic device having the aforesaid microphone module.

According to one aspect of this disclosure, a microphone module comprises a mounting seat, a buffer member and a microphone body. The mounting seat includes two oppositely spaced-apart upright suspension surfaces extending transversely from the top wall. The buffer member includes a main body disposed between and spaced apart from the suspension surfaces, and two suspension bumps protruding from the main body toward and abutting respectively and tightly against the suspension surfaces. The main body has an inner portion defining an accommodating space. The microphone body is disposed in the accommodating space.

According to another aspect of this disclosure, an electronic device comprises a housing including top and bottom walls, and a microphone module mounted in the housing. The microphone module includes a mounting seat, a buffer member and a microphone body. The mounting seat includes two oppositely spaced-apart upright suspension surfaces extending transversely from the top wall. The buffer member includes a main body disposed between and spaced apart from the suspension surfaces, and two suspension bumps protruding from the main body toward and abutting respectively and tightly against the suspension surfaces. The main body has an inner portion defining an accommodating space. The microphone body is disposed in the accommodating space.

Preferably, the mounting seat further includes a first abutment face connected between the suspension surfaces and spaced apart from the main body. The buffer member further includes at least one first bump protruding from the main body toward and abutting against the first abutment face.

Preferably, the mounting seat further includes a second abutment face connected transversely to the suspension surfaces and the first abutment face and spaced apart from the main body. The buffer member further includes a second bump protruding from the main body toward and abutting against the second abutment face.

Preferably, the buffer member includes a plurality of the first bumps protruding from the main body toward the first abutment face. The main body has a wire passing hole disposed between the first bumps and communicating the accommodating space with an external environment.

Preferably, the mounting seat further includes two spaced-apart ribs protruding from the bottom wall and spaced apart from the main body. The buffer member further includes an elongated bump protruding from the main body toward and abutting against the ribs.

Preferably, the buffer member further includes a tubular portion extending from the main body away from the accommodating space. The tubular portion communicates the accommodating space with an external environment and is transverse with an arrangement direction of the suspension bumps.

Preferably, the mounting seat further includes a positioning plate disposed between the suspension surfaces opposite to the first abutment face and abutting against one side of the tubular portion. The positioning plate has a positioning groove receiving a portion of the tubular portion.

Preferably, the positioning plate further has two abutment portions abutting against the main body. The positioning groove is formed between the abutment portions.

Preferably, the main body has an upright flat area on one side thereof, and an inclined area extending oppositely, downwardly, and inclinedly from a bottom end of the flat area.

Preferably, the buffer member is made of rubber with Shore A hardness greater than or equal to 30 degrees and less than or equal to 40 degrees.

Preferably, a ratio of a contact area of the buffer member with the mounting seat and a total area of an outer surface of the buffer member is greater than or equal to 0.05 but smaller than 0.2.

Preferably, the housing and the mounting seat are integrally formed as one piece.

Preferably, the electronic device is an internet telephone.

The efficiency of this disclosure resides in that by using the suspension bumps to abut tightly and respectively against the suspension surfaces, the main body of the buffer member is spaced apart from the mounting seat, and is stably fixed to the mounting seat through a small contact area between the suspension bumps and the suspension surfaces. Through this, vibration generated by an external environment or by other components in the electronic device (for example, sound waves generated by a speaker) and transmitted to the main body can be greatly reduced, thereby effectively preventing the microphone body inside the main body from producing noise and distortion caused by vibration during the sound reception. Hence, the overall quality of sound reception is enhanced.

BRIEF DESCRIPTION OF THE DRAWINGS

Other features and advantages of the disclosure will become apparent in the following detailed description of the embodiment with reference to the accompanying drawings, of which.

DETAILED DESCRIPTION OF THE PREFERRED EMBODIMENT

Referring to FIGS. 1 to 6, an electronic device 10 according to the embodiment of the disclosure is shown to comprise a housing 101, and a microphone module 100 mounted in the housing 101. In this embodiment, the electronic device 10 is an Internet telephone. However, in actual application, the electronic device 10 is not limited to the aforesaid disclosure.

Figure 1:
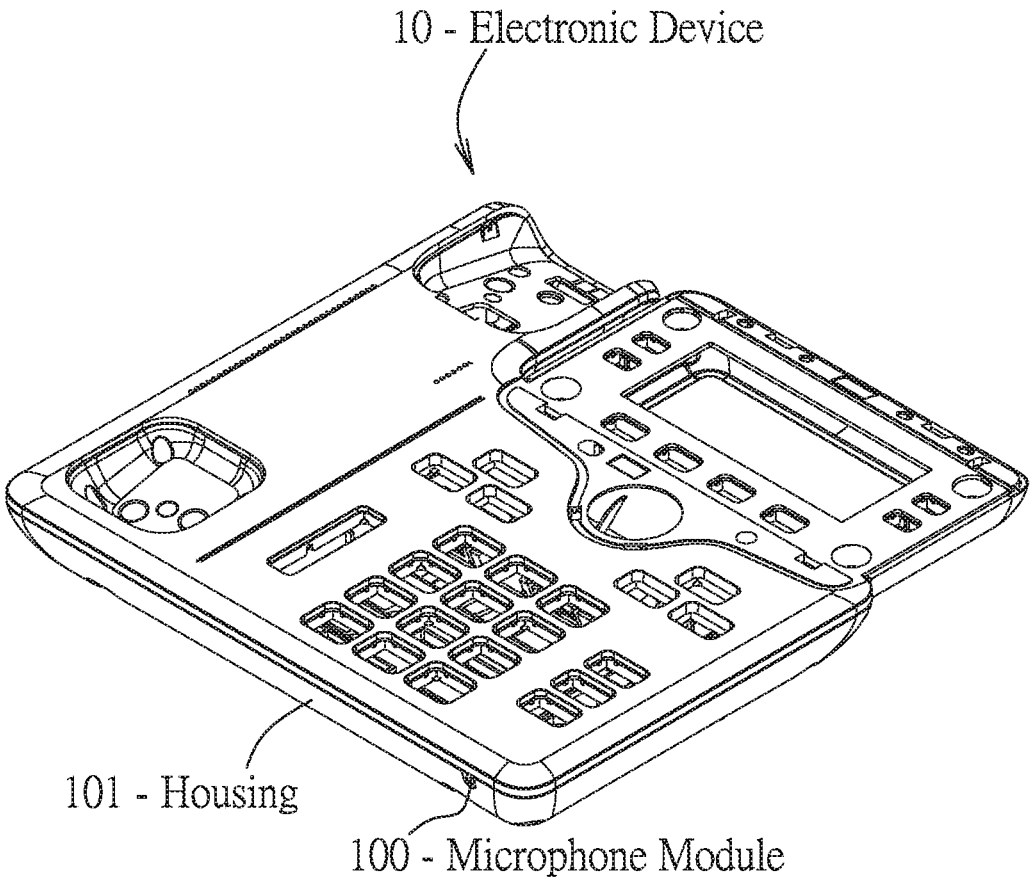
FIG. 1 is a perspective view of an electronic device according to the embodiment of the disclosure.
Figure 2:
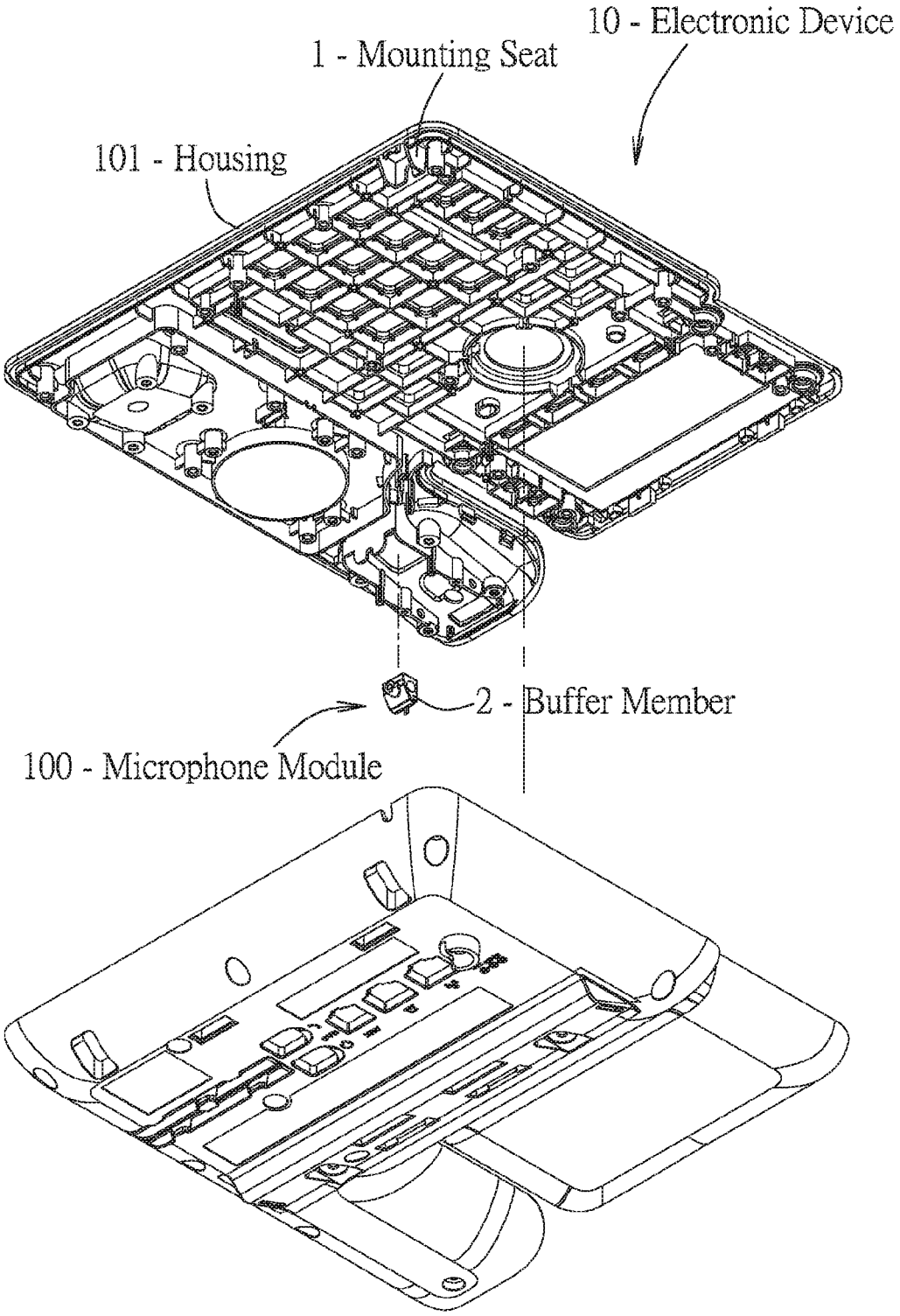
FIG. 2 is an exploded perspective view of the embodiment.
Figure 3:
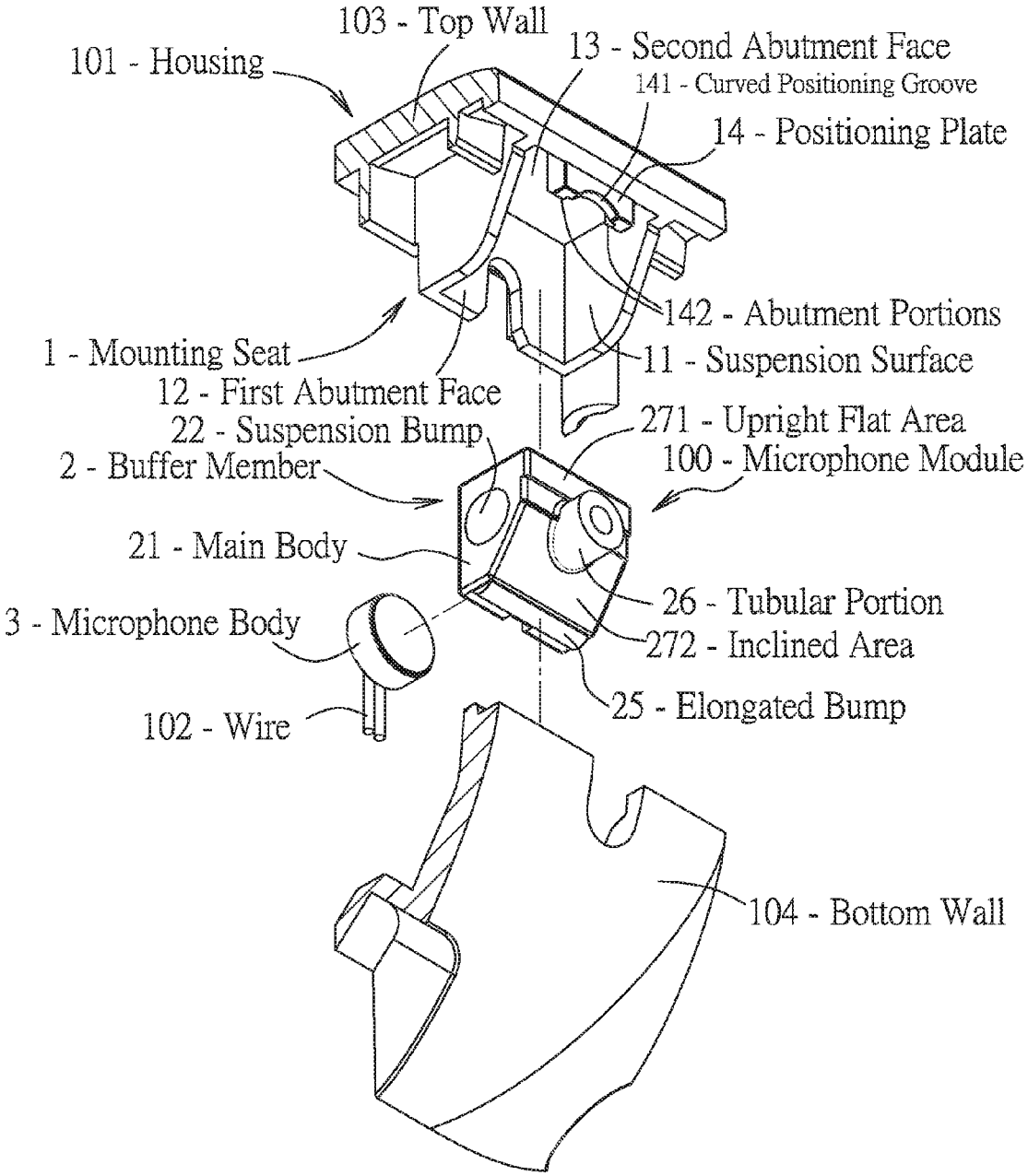
FIG. 3 is an exploded partly sectional view of a microphone module of the embodiment.
Figure 4:
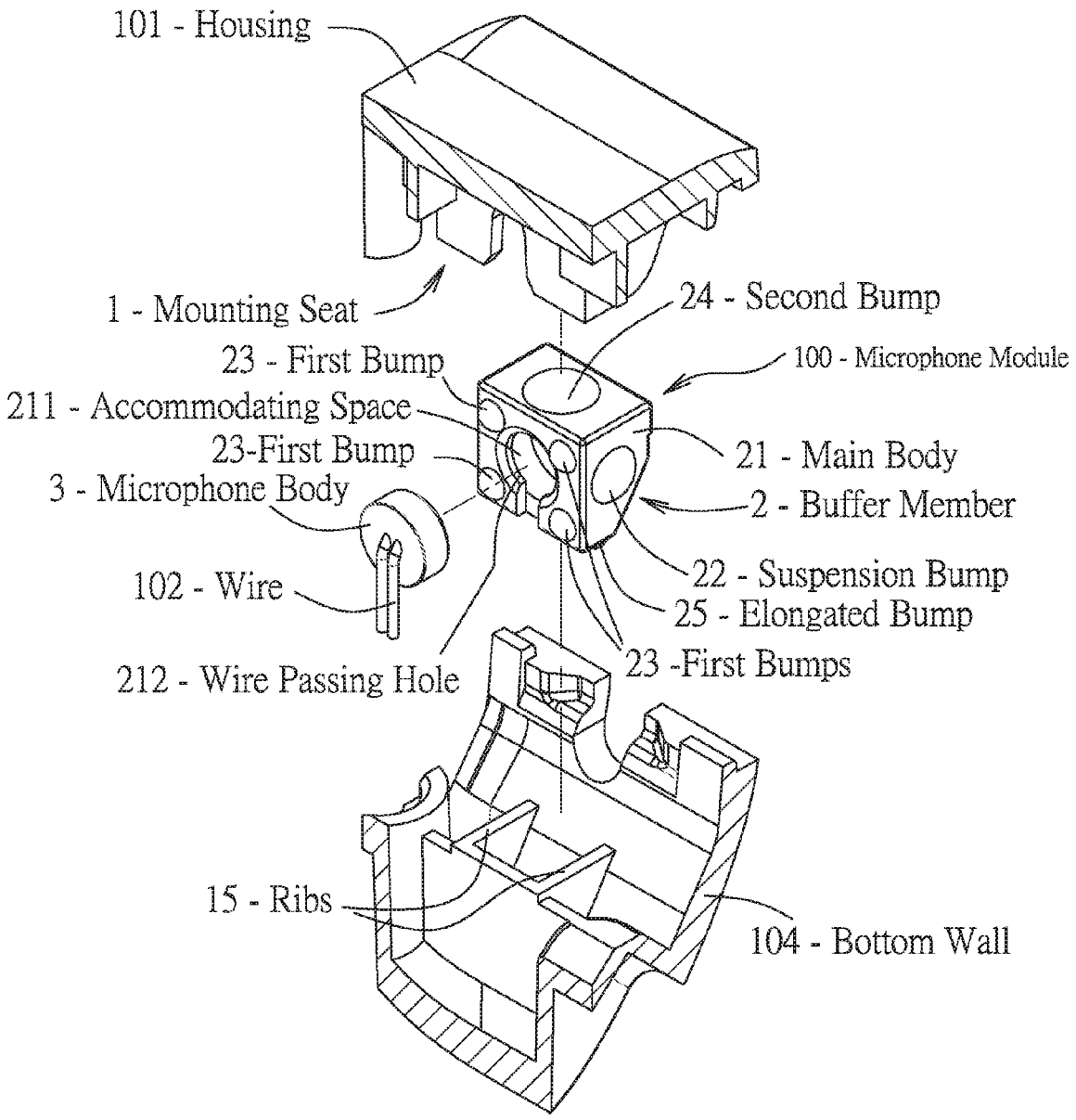
FIG. 4 is an exploded partly sectional view of the microphone module taken from another angle.
Figure 5:
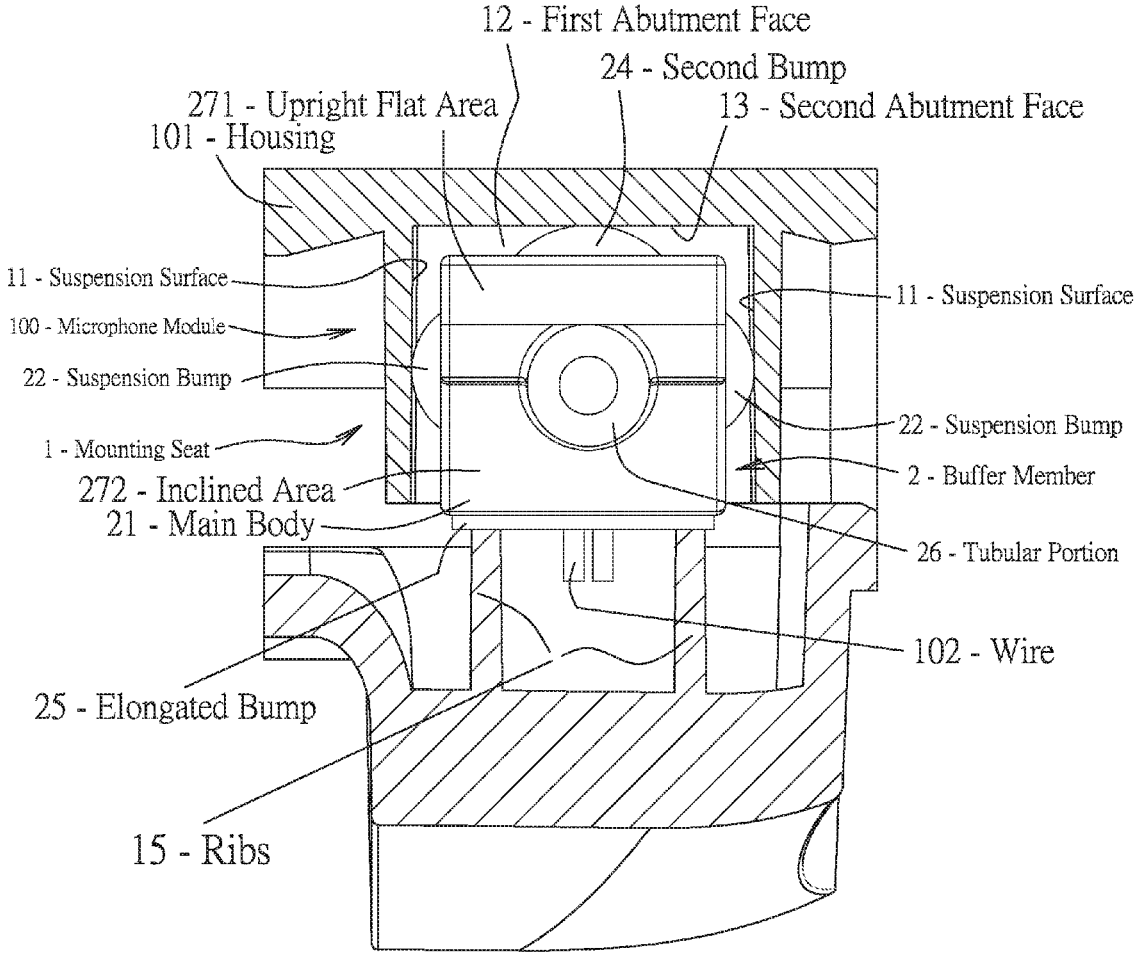
FIG. 5 is a sectional front view of the embodiment, illustrating an assembly of a mounting seat and a buffer member of the microphone module.
Figure 6:
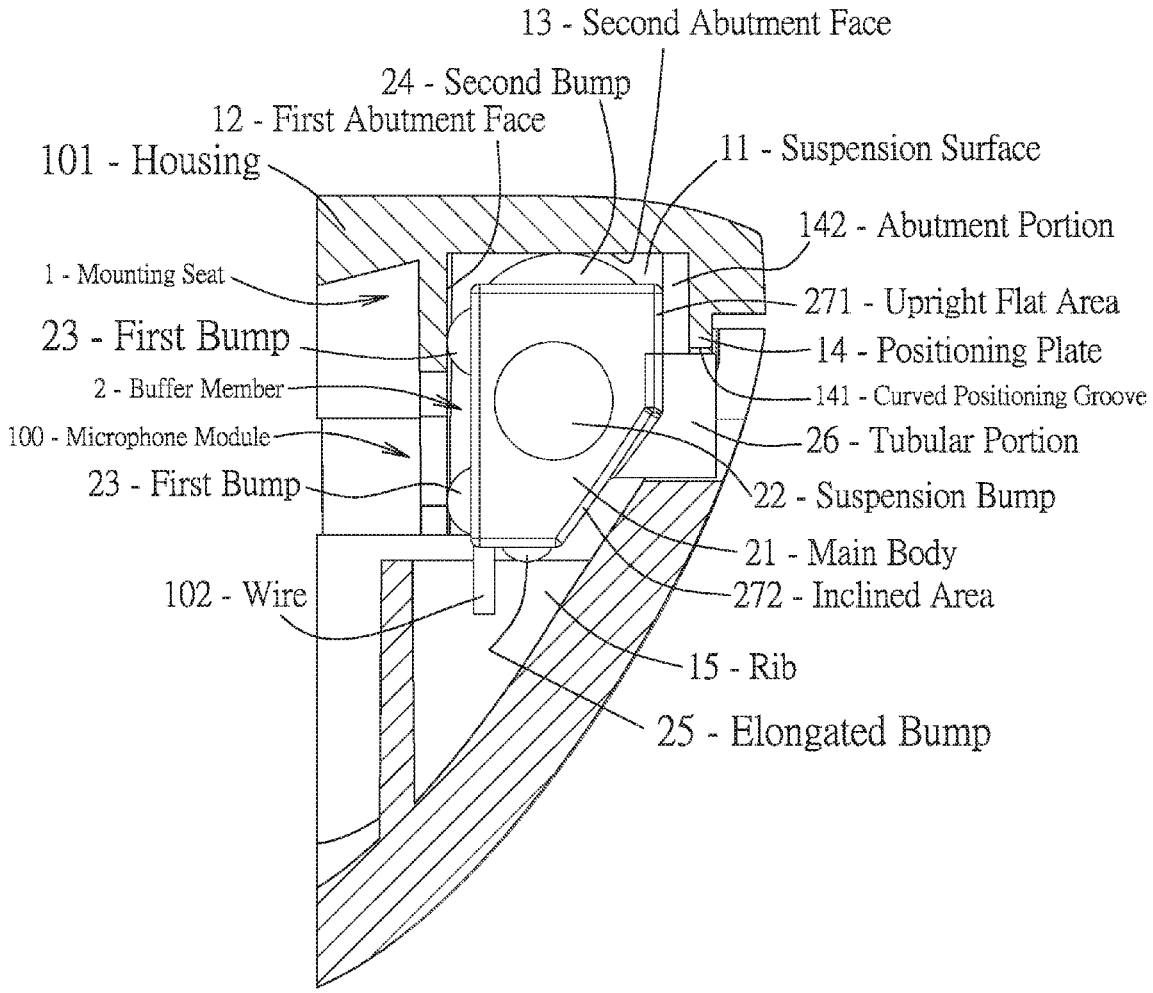
FIG. 6 is a sectional side view of the embodiment, illustrating the assembly of the mounting seat and the buffer member taken from another angle.

With reference to FIGS. 2 to 4, the microphone module 100 includes a mounting seat 1 integrally formed as one piece with a top wall 103 of the housing 101, a buffer member 2 mounted in the mounting seat 1, and a microphone body 3 disposed in the buffer member 2. The mounting seat 1 includes two oppositely spaced-apart upright suspension surfaces 11 (see FIG. 5) extending transversely from the top wall 103 and disposed on left and right sides of the buffer member 2, a first abutment face 12 that extends transversely from the top wall 103, that is connected between one ends of the suspension surfaces 11 and that faces a rear side of the buffer member 2, a positioning plate 14 that extends transversely from the top wall 103, that is disposed between the other ends of the suspensions surfaces 11 and that faces a front side of the buffer member 2, a second abutment face 13 that is integral with the top wall 103, that is surrounded by the suspension surfaces 11, the first abutment surface 12 and the positioning plate 14 and that faces a top side of the buffer member 2, and two ribs 15 that protrude from a bottom wall 104 of the housing 101, that are arranged spaced apart from each other in a left-right direction and that face a bottom side of the buffer member 2. The positioning plate 14 includes two abutment portions 142 protruding toward the buffer member 2.

With reference to FIGS. 3 to 6, the buffer member 2 includes a main body 21 disposed between the suspension surfaces 11, two spaced-apart suspension bumps 22 protruding from the main body 21 toward the suspension surfaces 11, respectively, four spaced-apart first bumps 23 protruding from the main body 21 toward the first abutment face 12, a second bump 24 protruding from the main body 21 toward the second abutment face 13, an elongated bump 25 protruding from the main body 21 toward the ribs 15, and a tubular portion 26 extending forwardly from a front side of the main body 21.

The main body 21 is spaced apart from the suspension surfaces 11, the first abutment face 12, the second abutment face 13 and the ribs 15, and has an inner portion defining an accommodating space 211 for accommodating the microphone body 3. The main body 21 has a wire passing hole 212 communicating the accommodating space 211 with an external environment. The wire passing hole 212 is surrounded by the first bumps 23, and is used for passing of a wire 102 of the electronic device 10 into the accommodating space 211 to electrically connect with the microphone body 3.

The suspension bumps 22 abut respectively and tightly against the suspension surfaces 11. Through this, the buffer member 2 is limited in the left-right direction, and is hung between the suspension surfaces 11. The front side of the main body 21 abuts against the abutment portions 142 of the positioning plate 14, while the first bumps 23 abut against the first abutment face 12. Through this, the buffer member 2 is limited in a front-rear direction. The elongated bump 25 extends across and abuts against the ribs 15, while the second bump 24 abuts against the second abutment face 13. Through this, the buffer member 2 is limited in a top-bottom direction. Through the foregoing structure, the buffer member 2 is limited in all directions, so that the buffer member 2 can be stably mounted in the mounting seat 1.

Figure 7:
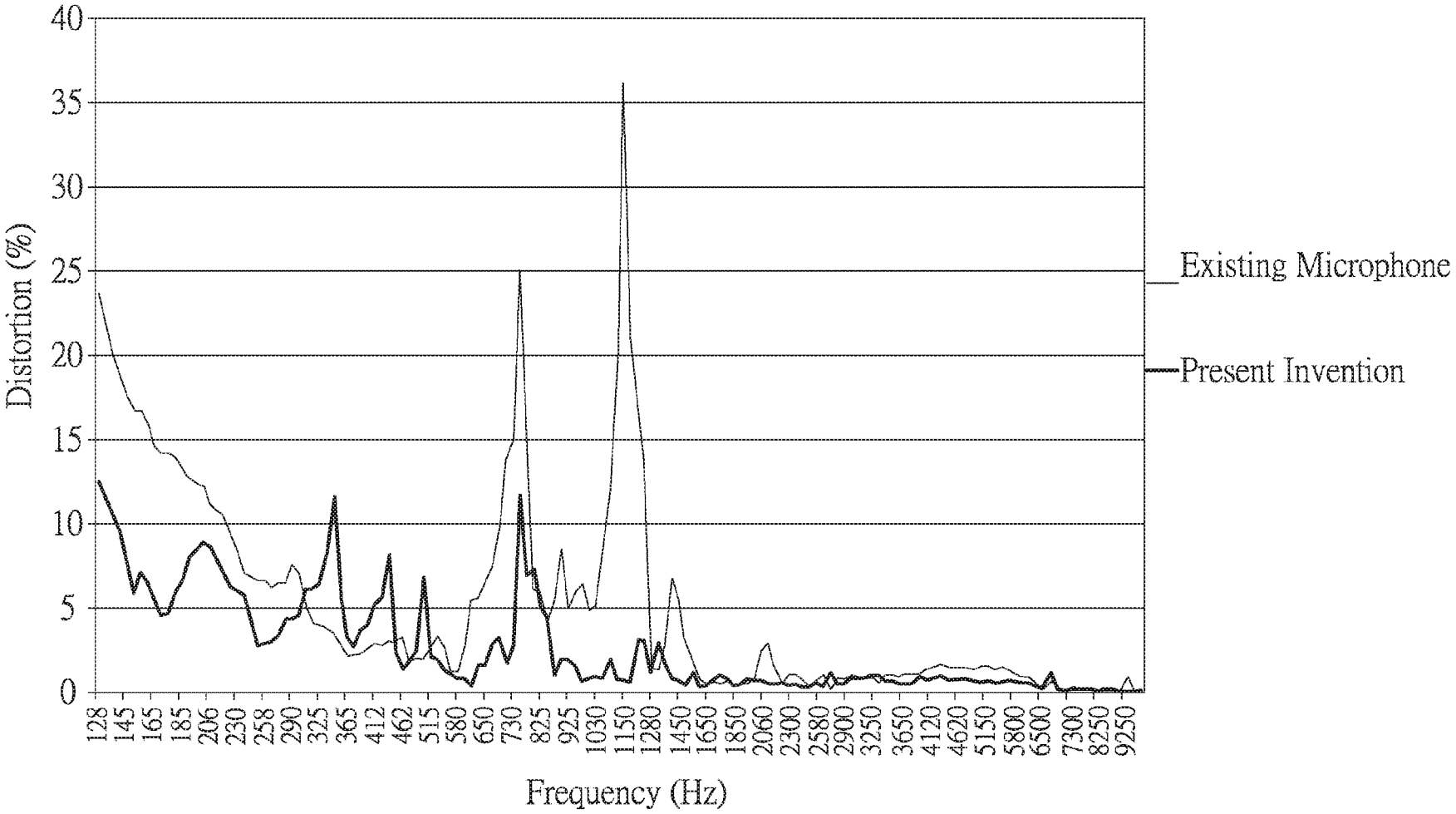
FIG. 7 is a graph, illustrating a relationship between frequency and distortion for this disclosure and an existing microphone.

By using the suspension bumps 22, the first bumps 23, the second bump 24 and the elongated bump 25 of the buffer member 2, the main body 21 of the buffer member 2 is spaced apart from the suspension surfaces 11, the first abutment face 12, the second abutment face 13 and the ribs 15 of the mounting seat 1, and is stably fixed to the mounting seat 1. Further, this significantly reduces a contact area between the mounting seat 1 and the buffer member 2, so that vibration generated in the electronic device 10 is not easily transmitted to the microphone body 3 through the mounting seat 1 and the buffer member 2. Referring to FIG. 7, a graph of a relationship between distortion and frequency for this disclosure and an existing microphone is illustrated for comparison. It is evident that the effect of vibration on the microphone module 3 to generate distortion noise is remarkably reduced, and especially improving the originally serious noise distortion in the frequency range between 650 Hz and 1280 Hz. It is worth to mention that because each of the suspension bumps 22, the first bumps 23, the second bump 24 and the elongated bump 25 has a curved cross section, there is only a point contact between each of the suspension bumps 22, the first bumps 23, the second bump 24 and the elongated bump 25 and a respective one of the suspension surfaces 11, the first abutment face 12, the second abutment face 13 and the ribs 15. Hence, an optimal vibration reduction effect is achieved.

Referring back to FIGS. 3 and 6, the tubular portion 26 of the buffer member 2 communicates the accommodating space 211 with an exterior of the housing 101, and extends from the front side of the main body 21 away from the accommodating space 211 and toward an outer side of the housing 101. Further, the tubular portion 26 is transverse with an arrangement direction of the suspension bumps 22. The positioning plate 14 abuts against a top edge of the tubular portion 26, and has a curved positioning groove 141 formed between the abutment portions 142 and corresponding in shape with the top edge of the tubular portion 26. Through this, the top edge of the tubular portion 26 can be received and positioned in the positioning groove 141 and prevented from moving leftward and rightward. Through the provision of the tubular portion 26, sound from the exterior of the housing 101 can enter the accommodating space 211 through the tubular portion 26 without any blockage, so that the sound reception of the microphone body 3 is clear.

It should be noted that the front side of the main body 21 of the buffer member 2 has an upright flat area 271 extending downwardly from a top end thereof, and an inclined area 272 extending downwardly, rearwardly and inclinedly from a bottom end of the flat area 271. The flat area 271 abuts against the abutment portions 142 of the positioning plate 14, so that the flat area 271 can cooperate with the first bumps 23 to stably fix the buffer member 2 in the front-rear direction. The inclined area 272 reduces the area of a bottom end of the main body 21 so as to decrease contact with the ribs 15, thereby reducing the transmission of vibration to the main body 21 through the mounting seat 1. As such, the quality of sound reception of the microphone body 3 is enhanced.

In this embodiment, the buffer member 2 is made of rubber with Shore A hardness greater than or equal to 30 degrees and less than or equal to 40 degrees. Through this, the buffer member 2 can have a good damping effect to absorb a portion of vibration transmitted from the mounting seat 1 to the buffer member 2 so as to protect the microphone body 3 inside the buffer member 2 from impact of vibration during sound reception. Moreover, when a ratio of a contact area of the buffer member 2 with the mounting seat 1 and a total area of an outer surface of the buffer member 2 is greater than 0.05 but smaller than 0.2, a more ideal effect in isolating vibration can be achieved. In this embodiment, the ratio between the contact area of the buffer member 2 with the mounting seat 1 and the total area of the outer surface of the buffer member 2 is around 0.07.

In sum, by using the suspension bumps 22, the first bumps 23, the second bump 24 and the elongated bump 25 of the buffer member 2 to respectively abut against the suspension surfaces 11, the first abutment face 12, the second abutment face 13 and the ribs 15 of the mounting seat 1, multiple contacts of the buffer member 2 with the mounting seat 1 are merely point contacts, and the ratio between the contact area of the buffer member 2 with the mounting seat 1 and the total area of the outer surface of the buffer member 2 is in the range of 0.05 to 0.2. Thus, vibration is not easily transmitted to the microphone body 3 through the mounting seat 1 and the buffer member 2, and noise and distortion caused by vibration can be avoided during the sound reception, thereby enhancing the overall quality of sound reception. Furthermore, by using rubber having Shore A hardness in the range of 30 to 40 degrees as a material for the buffer member 2, a damping effect for absorption of vibration is further produced. Therefore, the object of this disclosure is achieved.

While the disclosure has been described in connection with what is considered the most practical embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A microphone module comprising:

a mounting seat including two oppositely spaced-apart upright suspension surfaces;

a buffer member including a main body disposed between and spaced apart from said suspension surfaces, and two suspension bumps protruding from said main body toward and abutting respectively and tightly against said suspension surfaces, said main body having an inner portion defining an accommodating space; and a microphone body disposed in said accommodating space.

2. The microphone module as claimed in claim 1, wherein said mounting seat further includes a first abutment face connected between said suspension surfaces and spaced apart from said main body, said buffer member further including at least one first bump protruding from said main body toward and abutting against said first abutment face.

3. The microphone module as claimed in claim 1, wherein said mounting seat further includes two spaced-apart ribs disposed on one side of and spaced apart from said main body said buffer member further including an elongated bump protruding from said main body toward and abutting against said ribs.

4. The microphone module as claimed in claim 1, wherein said buffer member further includes a tubular portion extending from said main body away from said accommodating space, said tubular portion communicating said accommodating space with an external environment and being transverse with an arrangement direction of said suspension bumps.

5. The microphone module as claimed in claim 1, wherein said main body has an upright flat area on one side thereof, and an inclined area extending oppositely, downwardly, and inclinedly from a bottom end of said flat area.

6. The microphone module as claimed in claim 1, wherein said buffer member is made of rubber with Shore A hardness greater than or equal to 30 degrees and less than or equal to 40 degrees.

7. The microphone module as claimed in claim 1, wherein a ratio of a contact area of said buffer member with said mounting seat and a total area of an outer surface of said buffer member is greater than or equal to 0.05 but smaller than 0.2.

8. The microphone module as claimed in claim 2, wherein said mounting seat further includes a second abutment face connected transversely to said suspension surfaces and said first abutment face and spaced apart from said main body, said buffer member further including a second bump protruding from said main body toward and abutting against said second abutment face.

9. The microphone module as claimed in claim 2, wherein said buffer member includes a plurality of said first bumps protruding from said main body toward said first abutment face, said main body having a wire passing hole disposed between said first bumps and communicating said accommodating space with an external environment.

10. The microphone module as claimed in claim 4, wherein said mounting seat further includes a positioning plate disposed between said suspension surfaces opposite to said first abutment face and abutting against one side of said tubular portion, said positioning plate having a positioning groove receiving a portion of said tubular portion.

11. The microphone module as claimed in claim 10, wherein said positioning plate further has two abutment portions abutting against said main body, said positioning groove being formed between said abutment portions.

12. An electronic device comprising:

a housing including top and bottom walls; and a microphone module mounted in said housing and including a mounting seat including two oppositely spaced-apart upright suspension surfaces extending transversely from said top wall, a buffer member including a main body disposed between and spaced apart from said suspension surfaces, and two suspension bumps protruding from said main body toward and abutting respectively and tightly against said suspension surfaces, said main body having an inner portion defining an accommodating space, and a microphone body disposed in said accommodating space.

13. The electronic device as claimed in claim 12, wherein said mounting seat further includes a first abutment face connected between said suspension surfaces and spaced apart from said main body, said buffer member further including at least one first bump protruding from said main body toward and abutting against said first abutment face.

14. The electronic device as claimed in claim 12, wherein said mounting seat further includes two spaced-apart ribs protruding from said bottom wall and spaced apart from said main body, said buffer member further including an elongated bump protruding from said main body toward and abutting against said ribs.

15. The electronic device as claimed in claim 12, wherein said buffer member further includes a tubular portion extending from said main body away from said accommodating space, said tubular portion communicating said accommodating space with an external environment and being transverse with an arrangement direction of said suspension bumps.

16. The electronic device as claimed in claim 12, wherein said main body has an upright flat area on one side thereof, and an inclined area extending oppositely, downwardly, and inclinedly from a bottom end of said flat area.

17. The electronic device as claimed in claim 12, wherein said buffer member is made of rubber with Shore A hardness greater than or equal to 30 degrees and less than or equal to 40 degrees.

18. The electronic device as claimed in claim 12, wherein a ratio of a contact area of said buffer member with said mounting seat and a total area of an outer surface of said buffer member is greater than or equal to 0.05 but smaller than 0.2.

19. The electronic device as claimed in claim 12, wherein said housing and said mounting seat are integrally formed as one piece.

20. The electronic device as claimed in claim 13, wherein said mounting seat further includes a second abutment face connected transversely to said suspension surfaces and said first abutment face and spaced apart from said main body, said buffer member further including a second bump protruding from said main body toward and abutting against said second abutment face.

21. The electronic device as claimed in claim 13, wherein said buffer member includes a plurality of said first bumps protruding from said main body toward said first abutment face, said main body having a wire passing hole disposed between said first bumps and communicating said accommodating space with an external environment.

22. The electronic device as claimed in claim 15, wherein said mounting seat further includes a positioning plate disposed between said suspension surfaces opposite to said first abutment face and abutting against one side of said tubular portion, said positioning plate having a positioning groove receiving a portion of said tubular portion.

23. The electronic device as claimed in claim 22, wherein said positioning plate further has two abutment portions abutting against said main body said positioning groove being formed between said abutment portions.

* * * * *